United States Patent [19]

Schreiner

[11] 4,204,863

[45] May 27, 1980

[54] SINTERED CONTACT MATERIAL OF SILVER AND EMBEDDED METAL OXIDES

[75] Inventor: Horst Schreiner, Nuremberg, Fed. Rep. of Germany

[73] Assignee: Siemens Aktiengesellschaft, Berlin and Munich, Fed. Rep. of Germany

[21] Appl. No.: 859,242

[22] Filed: Dec. 9, 1977

[30] Foreign Application Priority Data

Dec. 27, 1976 [DE] Fed. Rep. of Germany ..... 2659012

[51] Int. Cl.[2] ..... C22C 1/04; C22C 1/10; B22F 1/00

[52] U.S. Cl. ..... 75/234; 200/265; 200/266; 252/514; 428/564; 428/565; 428/568; 428/929

[58] Field of Search ..... 75/206, 208 R, 234, 75/200; 428/564, 929, 565, 568; 200/265, 266; 252/514

[56] References Cited

U.S. PATENT DOCUMENTS

| | | | |
|---|---|---|---|
| 2,861,155 | 11/1958 | Farnham | 200/266 |
| 3,218,135 | 11/1965 | Alexander et al. | 428/565 |
| 3,360,348 | 12/1967 | Schreiner | 75/208 R |
| 3,385,677 | 3/1968 | Schreiner et al. | 252/514 X |
| 3,607,244 | 9/1971 | Kabayma | 200/266 X |
| 3,674,446 | 7/1972 | Haarbye et al. | 428/564 |
| 3,807,994 | 4/1974 | Jost | 428/929 X |
| 3,913,201 | 10/1975 | Schreiner et al. | 252/514 X |
| 3,930,849 | 1/1976 | Krock et al. | 252/514 X |
| 3,954,459 | 5/1976 | Schreiner et al. | 75/206 |
| 3,989,516 | 11/1976 | Haarbye | 200/266 X |
| 4,032,301 | 6/1977 | Hassler et al. | 428/929 X |

FOREIGN PATENT DOCUMENTS

| | | | |
|---|---|---|---|
| 2147460 | 4/1973 | Fed. Rep. of Germany | 428/929 X |

*Primary Examiner*—Richard E. Schafer
*Attorney, Agent, or Firm*—Kenyon & Kenyon

[57] ABSTRACT

A sintered contact material of silver and at least two embedded metal oxides for use in electrical contacts in which the metal oxides are distributed alternatingly in the silver in different microscopic zones of the sintered contact material.

11 Claims, 1 Drawing Figure

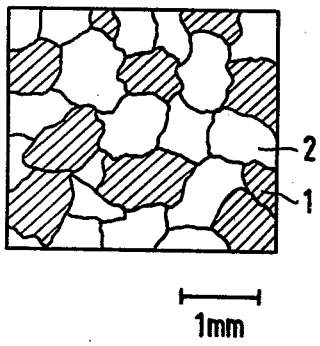
2
1
1mm

SINTERED CONTACT MATERIAL OF SILVER AND EMBEDDED METAL OXIDES

BACKGROUND OF THE INVENTION

This invention relates to sintered contacts in general and more particularly to an improved sintered contact material of silver and at least two embedded metal oxides and a method for the manufacture thereof.

In many applications, pure silver is not suited as a material for electrical contact elements. For, the silver surface is frequently partially melted and splattered in the arc which is generated in switching processes, particularly if contacts chatter when being closed. This leads, on the one hand, to a large amount of material burn-off and, on the other hand, also causes the contact elements to weld together, so that the latter can be separated only by the appliction of a force (known as the welding force). By embedding metal oxides, such as cadmium oxide, the welding force and the burn-off of silver contact elements can be reduced. Oxides of the metals copper, magnesium, calcium, zinc, cadmium, aluminum, indium, lanthanium, silicon, tin, cerium, samarium. lead, titatium, zirconium, antimony, bismuth, tellurium, chromium, molybdenum, manganese, iron, cobalt or nickel have also already been proposed singly or in combinations as embedments for silver containing contact materials. These additives are also used to improve other properties, for instance, arc propagation properties or contact resistance, to adapt the properties of the contact material to the requirements placed on the electrical contacts. In general, however, a measure which leads to an improvement of one property, e.g., the arc burn-off, causes a degradation of the other properties, e.g., the welding force.

Such contact materials can be produced by internal oxidation of an alloy powder of the metals in question and by pressing, sintering and coining by powder metallurgical methods. The size and distribution of the oxide particles contained in the silver then depends largely on the manner of the production. As a rule, small particle size and a distribution as uniform as possible is desired.

SUMMARY OF THE INVENTION

It is an object of the present invention to describe a material for a contact which consists of silver, as the base metal, and of a metal oxide, where, through the addition of at least one further metal oxide, one property of the material is improved without at the same time degrading other properties. Thus, for instance, the burn-off of an AgCdO contact element is to be improved and the welding force kept as small as possible at the same time.

According to the present invention, this is achieved with a sintered contact material of the type described at the outset, in which the metal oxides are alternatingly distributed in different microscopic zones in the silver.

Metal oxides which are of interest include the oxides of all metals which are suitable at all for use in silver containing materials. A number of such metal oxide additions which have already been proposed and tried for contact materials, were given at the outset.

In the sintered contact material according to the present invention, the metal oxides are therefore not distributed uniformly over the entire sintered contact material, i.e., all metal oxides are not present in the silver with the same concentration in every zone. The sintered contact material rather consists of different adjacent microscopic zones, the one metal oxide or a group of metal oxides being contained in the silver in zone, but another metal oxide or another group of metal oxides in the adjacent zone. Thus, for instance, zones of $AgMe_1O$ alternate side by side with zones of $AgMe_2O$, where $Me_1$ and $Me_2$ stand for different non-rare metals.

The mean "particle size" of the different AgMeO zones is preferably between 0.05 and 0.5 mm. In particular, the mean size is advantageously less than 0.2 mm.

The metal oxides are advantageously distributed in the form of particles with a mean size of between 0.1 and 20 μm in the individual zones. The mean size of the oxide particles is preferably above 0.5 μm. 5 μm can advantageously be given as an upper limit for the mean size of the oxide particles.

The sintered contact material can be further fabricated into semifinished material by extrusion or rolling. Thereby, a special structure or orientation of the zones or the oxide particles can be achieved. However, the sintered contact material can also be shaped into contact elements for electrical contacts during its manufacture.

For manufacturing the sintered contact material according to the present invention, a method in which at least two composite silver/metal oxide powders are throughly mixed with each other and pressed into a shaped body, and the shaped body subsequently then sintered is particularly well suited. The sintered shaped body can subsequently be densified by coining into a final form, e.g., a contact element. However, it can also be processed further by extrusion or rolling into semifinished material.

As is customary in powder metallurgy, a composite powder is understood to be a powder having individual particles which already consist of two or more materials. For the manufacture of the sintered contact material, one therefore starts out with as many different composite powders as there are zones of different composition to be provided in the sintered contact material. Each composite powder consists of silver and the metal oxide or metal oxides which are to be contained in the respective zone.

Building up the sintered contact material from zones of different composition makes it possible to improve one property in the one zone (e.g., the burn-off), while, however, the degradation of another property (e.g., the welding force) brought about in this zone is compensated or overcompensated by the metal oxide addition in another zone, so that, overall, an improvement of the entire spectrum of properties of the finished material is achieved.

The volume ratios of the amounts of the composite powders to be mixed together are advantageously between 0.1 and 1. In the sintered contact material, the total volume of all zones, in which one of the metal oxides is distributed, is then in the same ratio to the total volume of all zones, in which another metal oxide is distributed.

BRIEF DESCRIPTION OF THE DRAWING

The single FIGURE is a drawing of a microphotograph of the sintered contact material of the present invention.

DETAILED DESCRIPTION OF THE INVENTION

The invention will now be explained in detail with the aid of two examples.

Example 1

For contact elements, particularly in low voltage switchgear, a material with a small welding force and at the same time low burn-off is required. A contact material with silver as the base metal and 6% by weight cadium oxide and 3.75% by weight zinc oxide, relative to the finished material, which is made from a homogeneous mixture of these components, does not meet these requirements fully and is to be improved.

Through internal oxidation of the respective alloy powders, a composite powder of AgCdO with 12% by weight CdO and a composit powder of AgZnO with 7.5% by weight ZnO were prepared. The particle size of both powders was below 0.2 mm. The particle size of both powders was below 0.2 mm. The composite powders were the intimately mixed in the weight ratio of 1:1 and densified into a shaped part in a die at a pressure of 600 $NM/m^2$. The pressed body was subsequently sintered for 1 hour in air at 850 ° C. By coining with a pressure of 800 $NM/m^2$, the shaped part was given the desired final form of the contact element, a volumetric filling factor of 0.99 being obtained.

The shaped piece had the composition AgCdO6ZnO 3.75 and was tested in a test switch with a closing current $\hat{I} = 1000$ A and an opening current $\hat{I} = 1500$ A. As compared to the contact element of the same composition, in which the oxides are distributed uniformly, the burn-off valve was 25% and the welding force 50% better. The different zones of the materials are illustrated on the figure which is a drawing of a microphotograph of the sintered contact material. Shown are zones 1 of AgCdO and zones 2 of AgZnO. As illustrated on the figure, there is a uniform distribution of these different zones.

Example 2

Through internal oxidation, composite AgCuO and $AgCdOBi_2O_3$ powders were prepared from AgCu and AgCdBi alloy powders. The CuO and CdO volume content was 15% and the $Bi_2O_3$ volume 1%. The mean particle size of both powders was below 0.15 mm. The two composite powders were mixed in a weight ratio of 1:1 and densified in a die with a pressure of 600 $MN/m^2$ into a shaped part. The pressed body was subsequently sintered for 1 hour in air at 850° C. By hot coining the sintered body with a pressure of 600 $MN/m^2$, post-sintering at 800° C. for 1 hour in nitrogen and cold coining with a pressure of 800 $MN/m^2$, the shaped part was given the desired final form. The volumetric filling factor was above 0.99. As compared to the contact element of the same composition prepared from the powder mixture of silver powder and the metal oxides, the welding force was more than 50% lower, while the burn-off value was about the same.

What is claimed is:

1. A sintered contact material of silver and at least two embedded metal oxides made by steps comprising:

(a) preparing a first composite powder of silver and at least one metal oxide;

(b) preparing at least one further composite powder of silver, and at least one metal oxide using at least one metal oxide different from the metal oxides in the first composite powder;

(c) intimately mixing said first composite powder and said at least one further composite powder together;

(d) pressing the resulting mixture to form a shaped body; and (e) sintering the shaped body, whereby in the sintered shaped body, at least two of said metal oxides will be distributed in different zones of a mean size between 0.05 and 0.5 mm, and the differrent zones will be uniformly distributed throughout the sintered shaped body.

2. The sintered contact material according to claim 1, the mean size of said zones is between 0.05 and 0.2 mm.

3. The sintered contact material according to claim 1, wherein said metal oxides are distributed in the individual zones in the form of particles with a mean size of between 0.1 and 20 μm.

4. The sintered contact material according to claim 3, wherein the mean size of the oxide particles is above 0.5 μm.

5. The sintered contact material according to claim 3, wherein the mean size of the oxide particles is less than 5 μm.

6. The sintered contact material according to claim 1, wherein the ratio of the total volume of all zones, in which one of the metal oxides is distributed, to the total volume of all zones, in which another metal oxide is distributed, is between 0.1 and 1.

7. The sintered contact material according to claim 1 wherein said material is a semifinished material.

8. The sintered contact material according to claim 1 wherein said material is a contact element for electrical contacts.

9. A method for manufacturing a sintered contact material of silver and at least two embedded oxides comprising:

(a) preparing a first composite powder of silver and at least one metal oxide;

(b) preparing at least one further composite powder of silver, and at least one metal oxide using at least one metal oxide different from the metal oxides in the first composite powder;

(c) intimately mixing said first composite powder and said at least one further composite powder together;

(d) pressing the resulting mixture to form a shaped body; and (e) sintering the shaped body, whereby in the sintered shaped body, at least two of said metal oxides will be distributed in different zones of a mean size between 0.005 amd 0.5 mm, and the different zones will be uniformly distributed throughout the sintered shaped body.

10. The method according to claim 9, and further including subsequently densifying the sintered shaped body into the final form by coining.

11. The method according to claim 9, and further including subsequently densifying the sintered shaped body into a semifinished material by extrusion or rolling.

* * * * *